US006505987B1

(12) United States Patent
Turner, III et al.

(10) Patent No.: US 6,505,987 B1
(45) Date of Patent: Jan. 14, 2003

(54) ARTICLE HOLDER

(75) Inventors: David C. Turner, III, Farmington, NM (US); Bernadette A. Turner, Farmington, NM (US); Ted J. Sprinkle, Farmington, NM (US); Sheryl L. Sprinkle, Farmington, NM (US)

(73) Assignee: Sherrette, LLC, Farmington, NM (US)

( * ) Notice: Subject to any disclaimer, the term of this patent is extended or adjusted under 35 U.S.C. 154(b) by 0 days.

(21) Appl. No.: 09/778,906

(22) Filed: Feb. 8, 2001

Related U.S. Application Data

(63) Continuation-in-part of application No. 09/563,325, filed on May 3, 2000.

(51) Int. Cl.[7] ..... B42F 13/02

(52) U.S. Cl. ..... 402/19; 24/67.3; 24/67.11; 70/456 R; 402/70; 402/80 R; 403/42; D19/26

(58) Field of Search ..... 24/67 R, 67.3, 24/67.5, 67.9, 67.11; 70/456 R, 457, 458; D03/207, 208; D19/26, 54, 56, 86, 91; 402/19, 70, 73, 75, 80 R; 403/42, 166, 325

(56) References Cited

U.S. PATENT DOCUMENTS

| | | | | | |
|---|---|---|---|---|---|
| 123,360 | A | | 2/1872 | Porter et al. | |
| 247,300 | A | * | 9/1881 | Byron | |
| 416,373 | A | * | 12/1889 | O'Marra | |
| 904,618 | A | | 11/1908 | Kellner, Jr. | |
| 1,163,766 | A | | 12/1915 | Morden | |
| 1,208,663 | A | | 12/1916 | Rueckert | |
| 1,406,166 | A | * | 2/1922 | Bennett et al. | |
| 1,407,863 | A | | 2/1922 | Hochenauer, Jr. | |
| 1,443,522 | A | | 1/1923 | Buchan | |
| 1,522,607 | A | * | 1/1925 | Anderson | |
| 1,557,550 | A | * | 10/1925 | Benson | |
| 2,510,511 | A | | 6/1950 | Mittendorf | |
| 2,718,229 | A | * | 9/1955 | Gregory | |
| 2,803,281 | A | * | 8/1957 | Sutton | |
| 2,871,691 | A | | 2/1959 | Bacon | |
| 3,242,959 | A | | 3/1966 | Glass | |
| 3,745,800 | A | * | 7/1973 | Zentmyer | 70/458 |
| 3,896,526 | A | | 7/1975 | Joiner | |
| 4,165,890 | A | * | 8/1979 | Leff | 283/46 |
| 4,277,434 | A | | 7/1981 | Conway | |
| 4,500,223 | A | | 2/1985 | Downing et al. | |
| 4,538,429 | A | | 9/1985 | Bradford | |
| 4,614,450 | A | * | 9/1986 | Neiman | 281/31 |
| 4,682,792 | A | | 7/1987 | Simmons | |
| 4,792,253 | A | * | 12/1988 | Jacobson | 402/20 |
| 4,811,973 | A | | 3/1989 | Kumar-Misir | |
| 4,867,594 | A | | 9/1989 | Poulouin | |
| 4,925,328 | A | * | 5/1990 | Jefferies | 402/77 |
| 5,038,926 | A | | 8/1991 | Aart can der Toom | |
| 5,096,228 | A | | 3/1992 | Rinderknecht | |
| D337,200 | S | * | 7/1993 | Keller | D3/61 |
| 5,503,486 | A | | 4/1996 | Zane | |
| 5,533,236 | A | | 7/1996 | Tseng | |
| 5,692,847 | A | | 12/1997 | Zane et al. | |
| 5,944,353 | A | | 8/1999 | Sato | |
| 5,992,887 | A | | 11/1999 | Maruchi | |
| 6,095,711 | A | | 8/2000 | Garfinkle | |
| 6,113,298 | A | * | 9/2000 | Miro | 402/13 |
| 6,217,247 | B1 | * | 4/2001 | Ng | 402/36 |

* cited by examiner

*Primary Examiner*—A. L. Wellington
*Assistant Examiner*—Monica Carter
(74) *Attorney, Agent, or Firm*—Sughrue Mion, PLLC

(57) ABSTRACT

A device for holding plastic cards and keys includes an open ring formed into a shape such that the ends of the ring are opposed to one another and includes tips at the ends. A spine is located at the base of the open ring and a jacket is attached to the spine, for covering the cards. The distance between the tips is less than the thickness of a card or a key so that it can be inserted into the device by pushing an edge of the card or the key against the tips to spread the tips apart. The card or the key is slid in between the tips to fit a tip through a hole in the card or the key to hold it on the device. Cards or keys can be inserted or extracted without a separate step of opening or closing the device.

18 Claims, 8 Drawing Sheets

ARTICLE HOLDER

CROSS REFERENCE TO RELATED APPLICATIONS

This is a Continuation-in-part of application Ser. No. 09/563,325, filed May 3, 2000.

BACKGROUND OF THE INVENTION

1. Field of the Invention

The present invention relates to a device for keeping articles together, wherein the articles have a hole through which the device holds the articles and, more particularly, to an open ring-like device for holding articles and a novel method for inserting or extracting articles from the device.

2. Description of the Related Art

Cards such as credit cards or identification cards are used and often required for various purposes ranging from obtaining cash from an automatic teller machine or identifying oneself. These cards are commonly carried in the card pockets of wallets or purses. However, there are a limited number of pockets in a wallet or a purse, the visibility of the cards is restricted and a large number of cards can add an uncomfortable bulk to a wallet. Furthermore, extracting the cards can be a difficult task because the cards commonly have slippery surfaces and are stored in tightly fitting pockets.

U.S. Pat. No. 5,038,926 (van der Toorn) discloses a device which holds cards in a frame-like card holder with dimensions slightly larger than the card itself. Cards fit inside the holder which has a hole through which a ring keeps a number of holders together. However, this device requires the use of a holder for each of the cards and does not offer a novel approach to inserting or extracting cards from a ring.

U.S. Pat. No. 3,242,959 (Glass) discloses an invention which does not require a separate card holder for each of the cards. The invention uses cards modified with a slot and a hole located at the end of the slot. A spindle is slid into the slot and fitted into the hole. Unfortunately, this invention requires the use of specially manufactured cards or extensive card modification. These requirements are necessarily constrained by the information presented on the card surface in the form of a picture, a bar code or a magnetic strip.

U.S. Pat. No. 2,871,691 (Bacon) discloses a flexible one-piece key ring where a male end of the ring is inserted into a larger opposite distal female end of the ring whereby the location of barbs and gripping surfaces allow the ring to remain closed. However, the operation of this device requires a separate step of opening or closing the ring, in addition to inserting or extracting the keys.

U.S. Pat. No. 123,360 (Porter et al.) discloses a device designed to hold paper tickets. The device is a ring where one distal end is in the shape of a hook and an opposite distal end is in the shape of an eye. The ring is opened by dislodging the hook from the eye. The holes on the tickets are threaded through the hook to insert the tickets on the ring. Like the Bacon invention above, this invention requires a separate step of opening or closing the ring and inserting or extracting the tickets. Furthermore, the inner edge of the top half of the ring has a sharp edge so that tickets can be torn out, a feature not appropriate for keeping plastic cards.

U.S. Pat. No. 1,407,863 (Hochenauer) discloses a ring-shaped device where there is a ball fixed at one end of a ring. The ball partially fits into an opening at the opposite distal end of the ring. The ring is opened by laterally pushing the ball end out of alignment with the opposite distal end. Like the inventions mentioned above, this invention requires the user to manually open the ring and an additional step of inserting or extracting an article.

SUMMARY OF THE INVENTION

It is an object of the present invention to provide a device to hold articles which overcomes the above-mentioned difficulties associated with the previous devices.

The present invention relates to a device which facilitates the insertion and extraction of articles. An article can be inserted into the device by sliding the article in between tips disposed at the opening of the device and threading the device through a hole in the article. To extract an article, the article is simply pulled out through the tips.

In particular, the present invention relates to a device for holding together articles, comprising an open ring not limited to an annular shape. The ring is formed into a configuration such that distal ends are opposed to one another. Tips are disposed at each of the distal ends of the ring, the tips being operative to be displaced apart with respect to each other by an article. The tips will be sufficiently displaced to create an opening between the distal ends to allow the article to be inserted or extracted from the device. In one embodiment, the tips are preferably, but not necessarily, of spherical shape. Alternatively, in another embodiment, the tips further comprise an encasement disposed at each distal end, a biasing component inside each encasement, and an end tip disposed at an end of each encasement.

In addition, the invention further relates to a device which includes a jacket attached to the ring to cover articles held on the ring.

It is a further object of the present invention to provide a method of holding articles together by forming an open ring not limited to an annular shape. The ring is formed into a configuration such that distal ends are opposed to one another and tips are disposed at the distal ends. Next, the method comprises pushing an edge of an article in between the tips to displace the tips apart. Finally, the method comprises sliding the article in between the tips, and threading a distal end through a hole in the article. In one embodiment, the tips are preferably, but not necessarily, of spherical shape. Alternatively, in another embodiment, the method further comprises pushing an end tip into an encasement disposed at the distal end, against a biasing component inside the encasement.

In addition, the method further comprises attaching a jacket on the ring to cover articles held on the ring.

Lastly, it is a still further object of the present invention to provide a device for holding together cards or keys, comprising an open ring in one of an annular and a non-annular shape, formed into a configuration such that the distal ends are opposed to one another. The tips disposed at each of the distal ends of the ring are operative to be displaced apart with respect to each other by pushing an edge of a card or a key against the tips to insert or extract the card of the key from the device. The device includes a spine member disposed at the base of the open ring, and a jacket for covering the cards or keys, attached to the spine member.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

Figure 1:
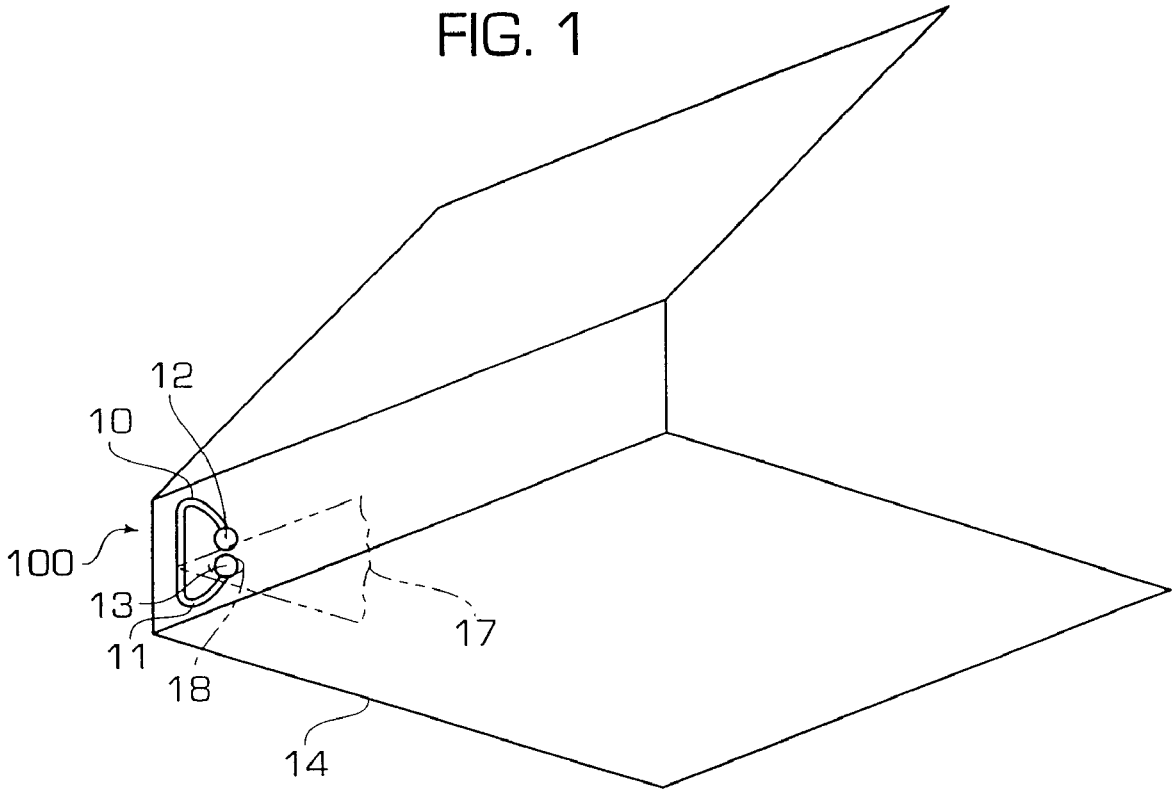
FIG. 1 is a perspective view of an article holder of a first embodiment attached to a jacket according to the present invention.

The present invention will now be described with reference to the drawings. Shown in FIG. 1 is an article holder in the form of a first embodiment of the present invention. The device comprises an open ring 100 not limited to an annular shape, with opposing distal ends 10, 11. A tip 12 is disposed at the distal end 10 and a tip 13 is disposed at the opposing distal end 11. In their rest positions, the opposing tips 12, 13 are separated by a distance less than the thickness of an article 17. For example, the distance between the tips 12, 13 is less than approximately 1 mm for an article holder carrying bank debit cards, credit cards, club membership cards, or the like. In FIG. 1, the tips 12, 13 are preferably, but not necessarily, spherical or ball members.

The operation of this embodiment will be described in the following.

Figure 4:
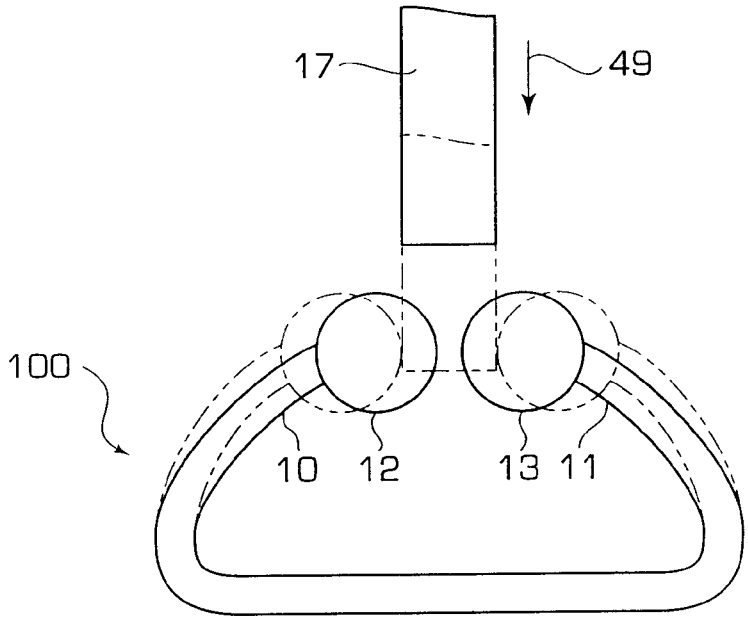
FIG. 4 is a lateral view of an article holder of the first embodiment showing an action of inserting an article according to the present invention.

FIG. 4 shows the action of inserting an article 17 into the ring 100 of the first embodiment. To insert the article 17, an edge of the article is pushed in between the tips 12, 13. The pushing force 49 displaces the tips 12, 13 from their rest positions to allow the article 17 to slide in between the tips 12, 13. The tips 12, 13 are aligned with a hole 18 (in FIG. 1) in the article 17 to return the tips 12, 13 to their rest positions. Tip 12 is threaded through the hole 18 (in FIG. 1) to complete the insertion of the article 17 on the ring 100. Alternatively, tip 13 is threaded through the hole 18 (in FIG. 1) to complete the insertion of the article 17 on the ring 100.

To extract an article, hole 18 (in FIG. 1) in the article 17 is aligned in between the tips 12, 13 and pulled out. The pulling force will displace the tips 12, 13 to allow the article 17 to slide off the ring 100. After the article 17 is extracted, the tips 12, 13 are returned to their rest positions.

A method of holding articles together is explained below in connection with FIG. 4. The open ring 100 not limited to an annular shape, is formed into a configuration such that the distal ends 10, 11 are opposed to one another and tips 12, 13 are disposed at the distal ends 10, 11. In their rest positions, the tips 12, 13 are separated by a distance less than the thickness of an article 17. An edge of the article 17 is pushed by pushing force 49 in between the tips 12, 13 to displace the tips 12, 13 apart, and is slid in between the tips 12, 13. Tip 12 is threaded through a hole 18 (in FIG. 1) in the article 17 and the tips 12, 13 return to their rest positions to complete the insertion of the article 17 on the ring 100. Alternatively, tip 13 is threaded through the hole 18 (in FIG. 1) in the article 17 and the tips 12, 13 return to their rest positions to complete the insertion of the article 17 on the ring 100.

To extract an article, hole 18 (in FIG. 1) in article 17 is aligned in between the tips 12, 13. Article 17 is pulled out, displacing the tips 12, 13 apart. When the article 17 is completely removed from the ring 100, the end tips 12, 13 return to their rest positions.

Figure 2:
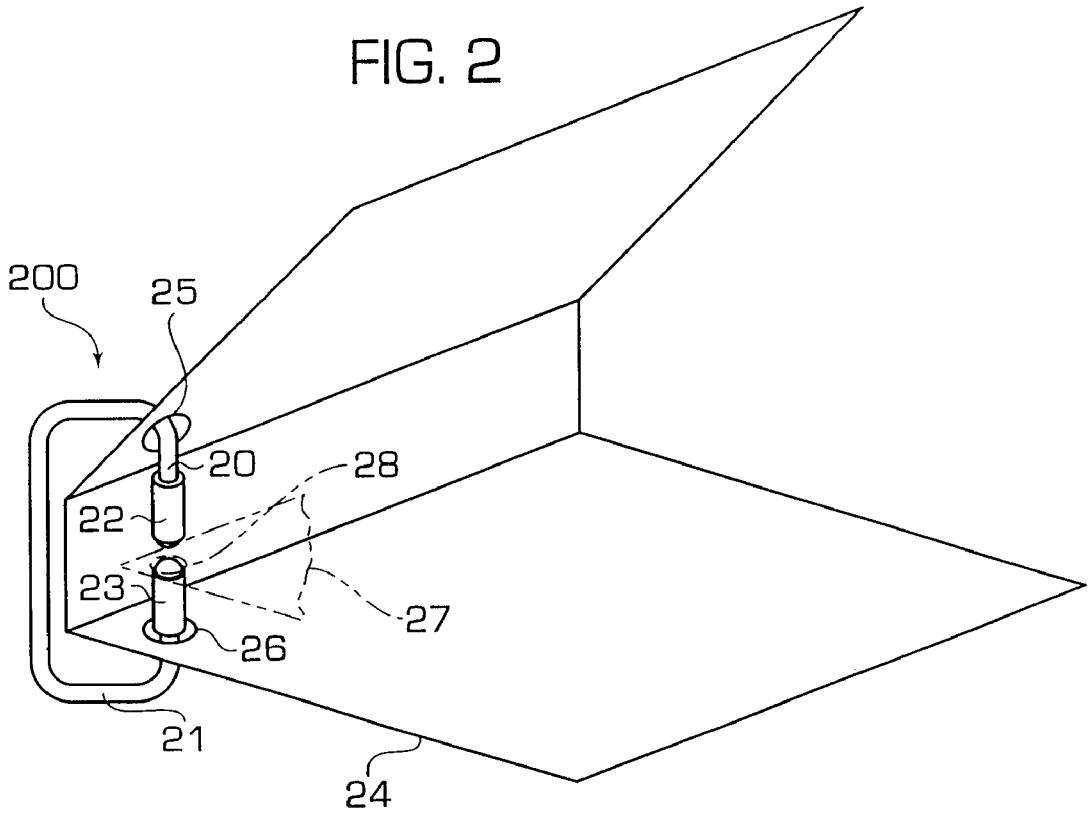
FIG. 2 is a perspective view of an article holder of a second embodiment fitted to a jacket according to the present invention.
Figure 3:
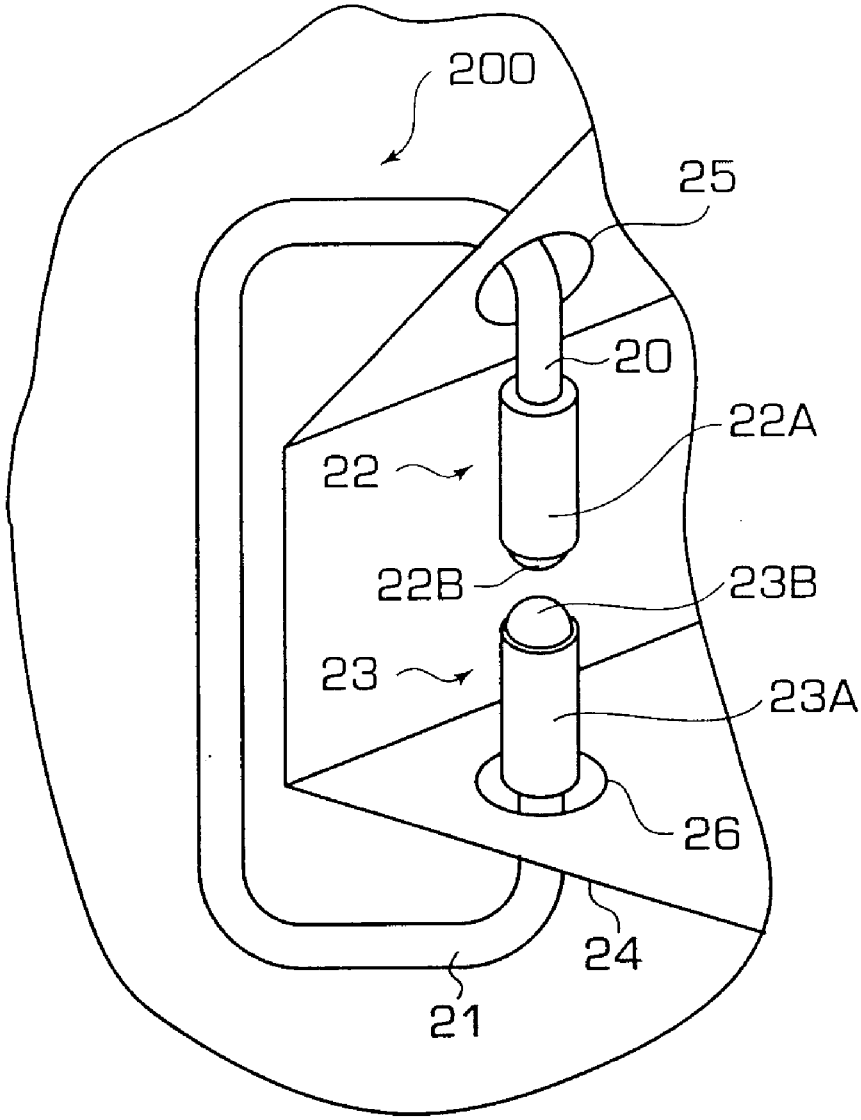
FIG. 3 is a fragmentary close-up view of an article holder of the second embodiment according to the present invention.

A second embodiment of the device is shown in FIG. 2. The device comprises an open ring 200 not limited to an annular shape, formed into a configuration such that distal ends 20, 21 are opposed to one another. A tip 22 is disposed at a distal end 20 and a tip 23 is disposed at the opposing distal end 21. FIG. 3 is a fragmentary close-up view of the second embodiment in FIG. 2. Representative of tip 22, tip 23 will be described in detail.

Tip 23 has an encasement 23A disposed at the distal end 21. An end tip 23B is disposed at the end of the encasement 23A opposite the end of the encasement 23A disposed at the distal end 21. The end of the encasement 23A opposite from the end disposed at the distal end 21, is tapered and of dimensions less than that of the end tip 23B to prevent the end tip 23B from falling out of the encasement 23A. The end tips 22B, 23B are preferably, but not necessarily, spherical or ball members. In their rest positions, the opposing end tips 22B, 23B are separated by a distance less than the thickness of an article 27. Biasing components 22C, 23C (shown in FIG. 5) are disposed within the encasements 22A, 23A.

The biasing components 22C, 23C are preferably, but not necessarily, coil compression springs. Alternatively, the biasing components 22C, 23C may be elastomer members. Further, the biasing components 22C, 23C may be, alternatively, metal members formed into a configuration with a resilient property. Still further, the biasing components may be, alternatively, metal members formed in an accordion shape with a resilient property.

The operation of the second embodiment will be described in the following.

Figure 5:
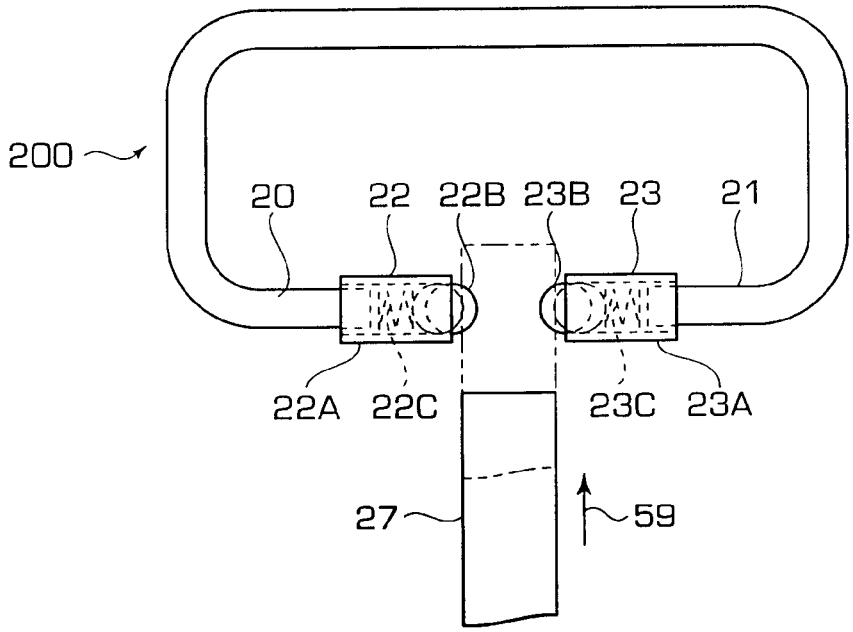
FIG. 5 is a lateral view of an article holder of the second embodiment showing an action of inserting an article according to the present invention.

The insertion of an article 27 is shown in FIG. 5. The edge of the article 27 is pushed in between the end tips 22B, 23B, displacing the end tips 22B, 23B into their respective encasements 22A, 23A against the bias of the biasing components 22C, 23C. The displacement of the end tips 22B, 23B allows the article 27 to slide in between the end tips 22B, 23B. Distal end 22 is threaded through a hole 28

(in FIG. 2) in the article 27. Alternatively, distal end 23 is threaded through the hole 28 (in FIG. 2) in the article 27. By the action of the biasing components 22C, 23C, the end tips 22B, 23B return to their rest positions.

To extract an article 27, the hole 28 (in FIG. 2) in the article 27 is lined up with the end tips 22B, 23B and pulled out. The pulling force will displace the end tips 22B, 23B to allow the article 27 to slide off the ring 200. After the article 27 is extracted, the end tips 22B, 23B return to their rest positions by the action of the biasing components 22C, 23C.

An alternative method of holding articles together is explained below in connection with FIG. 5. The ring 200 not limited to an annular shape is formed into a configuration such that the distal ends 20, 21 are opposed to one another and tips 22, 23 are disposed at the distal ends 20, 21. Encasements 22A, 23A are disposed at the distal ends 20, 21. End tips 22B, 23B disposed at the end of encasements 22A, 23A, are separated by a distance less than the thickness of an article 27, in their rest positions.

An edge of the article 27 is inserted by pushing force 59 in between the tips 22, 23, displacing the end tips 22B, 23B into the encasements 22A, 23A, against the action of biasing components 22C, 23C disposed inside the encasements 22A, 23A. When a hole 28 (in FIG. 2) in the article 27 is aligned with the end tips 22B, 23B, the end tips 22B, 23B are returned to their rest positions by the action of the biasing components 22C, 23C. Tip 22 is threaded through the hole 28 (in FIG. 2) in the article 27 to complete the insertion of the article 27. Alternatively, tip 23 is threaded through the hole 28 (in FIG. 2) in the article 27 to complete the insertion of the article 27.

To extract an article, hole 28 (in FIG. 2) in article 27 is aligned in between the end tips 22B, 23B. Article 27 is pulled out, displacing the end tips 22B, 23B into the encasements 22A, 23A. When the article 27 is completely removed from the ring 200, the biasing components 22C, 23C push the end tips 22B, 23B back to their rest positions.

Figure 6:
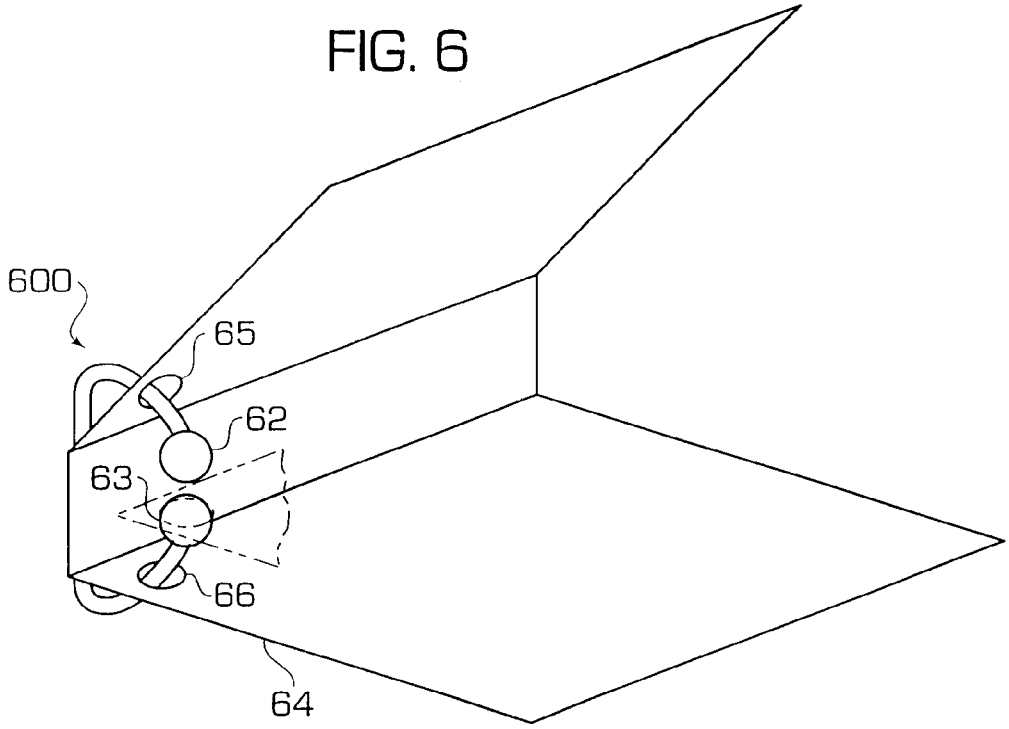
FIG. 6 is a perspective view of an article holder of the first embodiment fitted on the outside of a jacket with tips inside the jacket according to the present invention.
Figure 8:
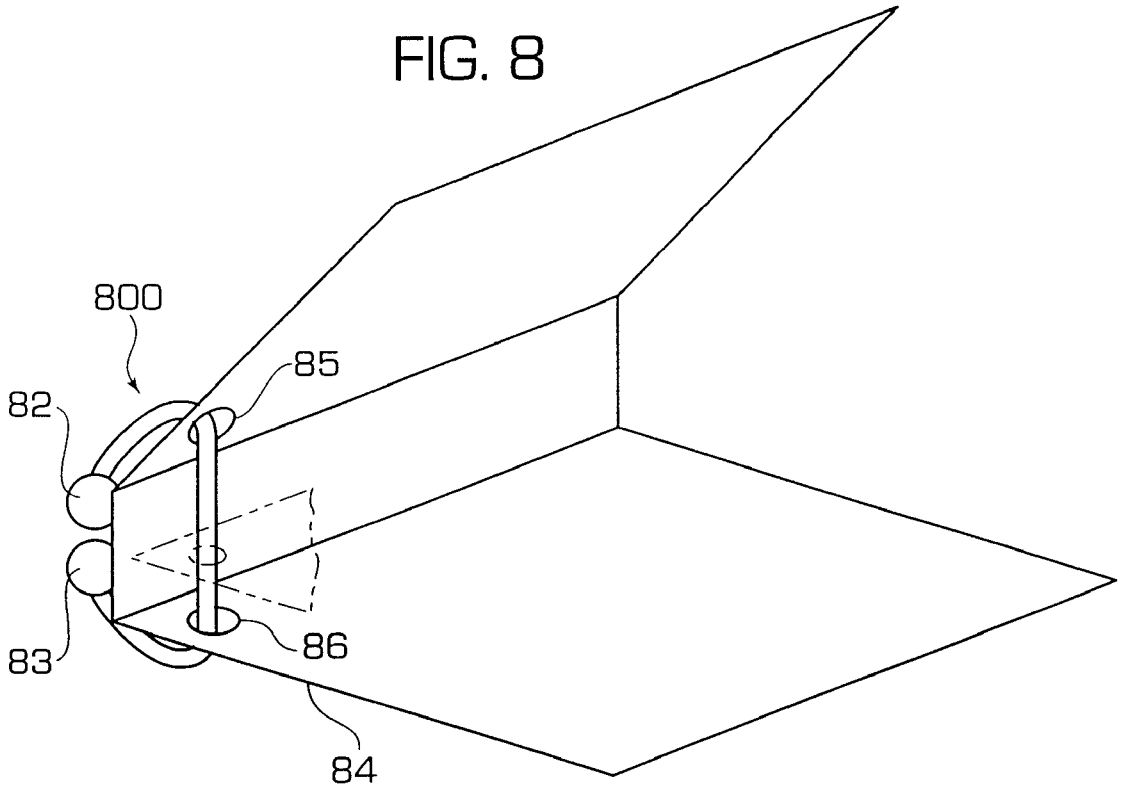
FIG. 8 is a perspective view of an article holder of the first embodiment fitted on the outside of a jacket, with tips outside the jacket according to the present invention.

In addition to the embodiments described above, a jacket, formed from leather, cloth, canvas, plastic, metal, or the like, may be provided which covers the articles held on the ring. FIG. 1 shows the ring 100 of the first embodiment attached inside a jacket 14. Additionally, FIG. 6 shows a ring 600 fitted on the outside of a jacket 64 through through-holes 65, 66 and oriented so that the tips 62 and 63 are inside the jacket 64. Furthermore, FIG. 8 shows a ring 800 fitted on the outside of a jacket 84 through through-holes 85, 86 and oriented so that the tips 82, 83 are outside the jacket 84.

Figure 7:
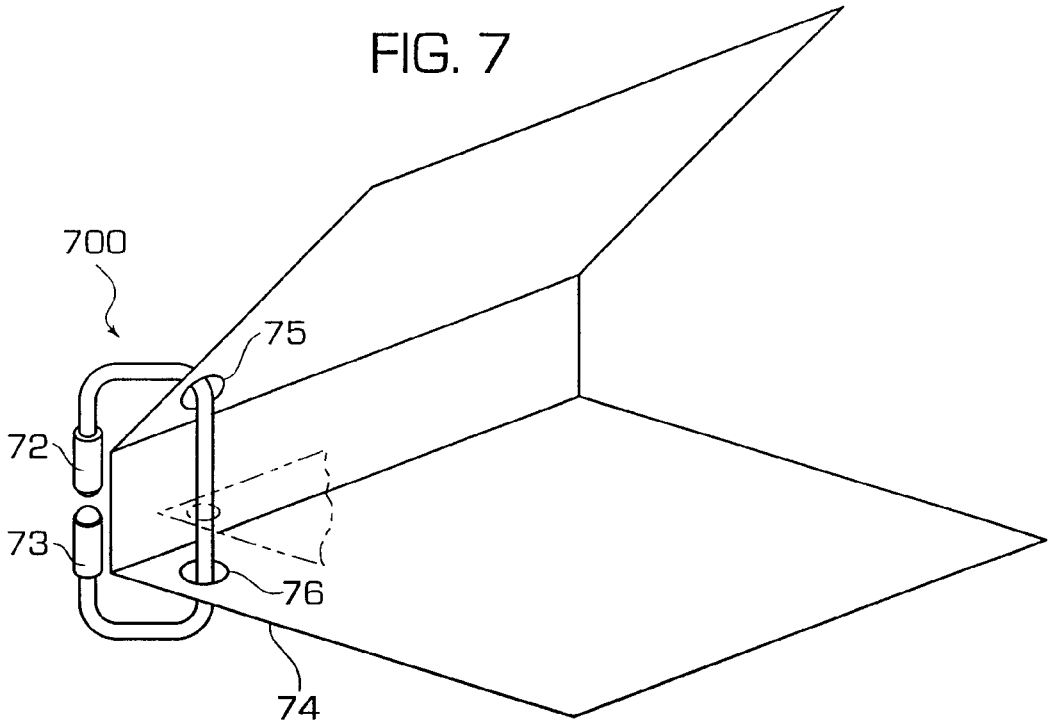
FIG. 7 is a perspective view of the article holder of the second embodiment fitted on the outside of a jacket, with tips outside the jacket according to the present invention.

FIG. 2 shows a ring 200 of the second embodiment fitted on the outside of a jacket 24 through through-holes 25, 26 with the tips 22, 23 inside the jacket 24. Alternatively, the ring 200 may be attached inside the jacket 24 with the tips 22, 23 inside the jacket 24, similar to the first embodiment of FIG. 1. Moreover, FIG. 7 shows a ring 700 fitted on the outside of a jacket 74 through through-holes 75, 76 with the tips 72, 73 outside the jacket 74.

Alternatively, the ring may be sewn on the jacket. Further, the ring may be, alternatively, laced to the jacket. Still further, the ring may be, alternatively, threadedly disposed within the jacket material.

Figure 9:
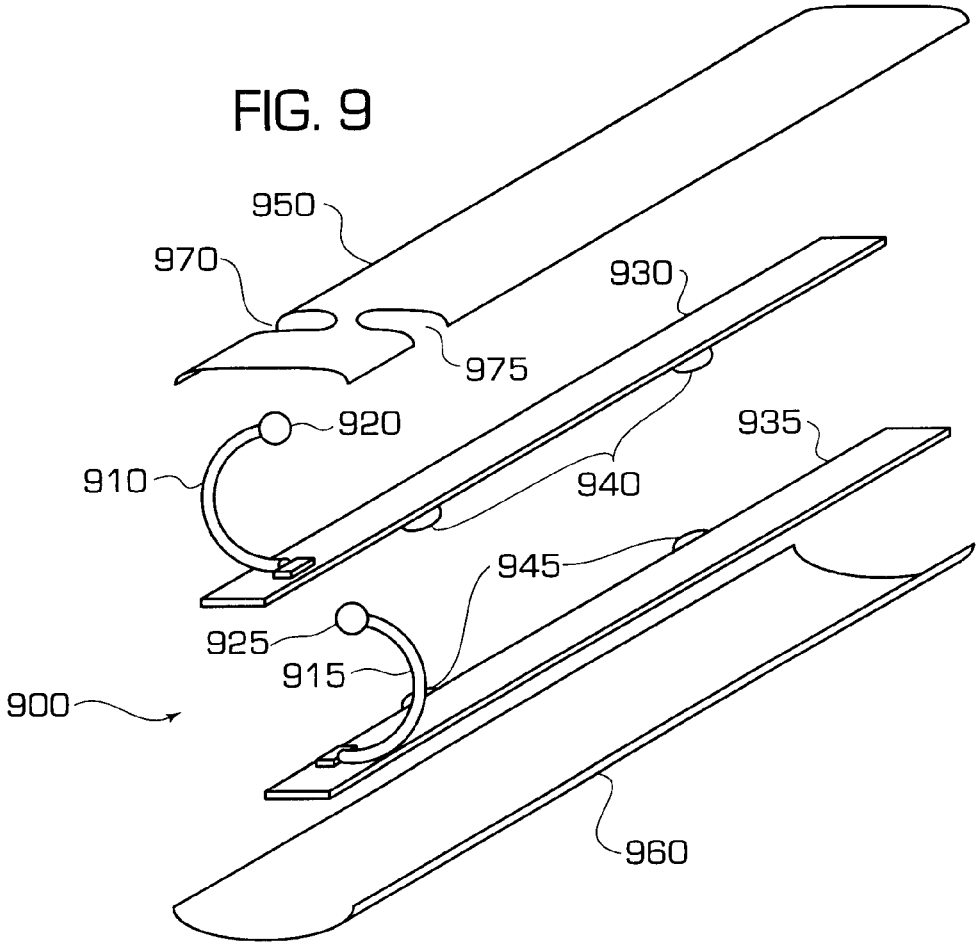
FIG. 9 is an assembly diagram of an article holder of the third embodiment.
Figure 14:
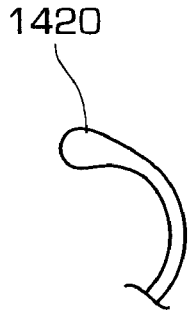
FIG. 14 is a fragmentary close-up view of a tip with a teardrop shape, of an embodiment according to the present invention.
Figure 15:
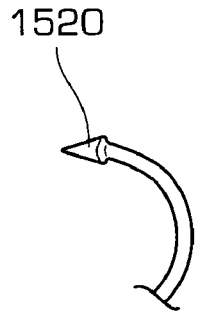
FIG. 15 is a fragmentary close-up view of a tip with a tapered shape, of an embodiment according to the present invention.

A third embodiment of the device is shown in FIG. 9. The article holder 900 comprises a pair of opposing annular half-rings 910, 915 formed into a configuration such that a distal end of one half-ring opposes a distal end of another half-ring. Ball-shaped tips 920, 925 are disposed at the distal end of half-rings 910, 915, respectively. The ball-shaped tips may have a diameter greater than the cross-sectional diameter of the half-rings 910, 915, and may be rigidly fixed to the distal ends, as depicted in FIG. 9. At the base of the pair of half-rings 910, 915, there is a spine 970 (in FIGS. 9–10) extending in a direction substantially normal to the plane of the pair of half-rings 910, 915. Alternatively, the pair of half-rings 910, 915 may have a non-annular shape. Further, instead of a ball-shaped tip, there may be a teardrop-shaped tip 1420 (in FIG. 14), a tapered tip 1520 (in FIG. 15), or the like disposed at the distal end of each half-ring.

Inside the spine 970, there is an inner longitudinal member 980 (in FIGS. 9–10), comprising a pair of opposing and abutting leaves 930, 935, disposed at the base of the half-rings 910, 915, respectively. Each leaf hingedly cooperates with the opposing leaf along its longitudinal medial edge. Along the longitudinal medial edge of a leaf, there is a pair of tabs. Tabs 940 on leaf 930 and tabs 945 on leaf 935, limit the hinge motion of the pair of leaves 930, 935.

Above the pair of leaves 930, 935, there is an upper cover 950 with beveled longitudinal edges extending downward and a pair of apertures 970, 975 through which the half-rings 910, 915 project. Under the pair of leaves 930, 935, there is a lower cylindrical cover 960 with beveled longitudinal edges extending upward and inward. Each longitudinal edge of the lower cylindrical cover 960 is disposed between an overlapping longitudinal edge of the upper cover 950 and an outer longitudinal edge of a leaf.

Figure 12:
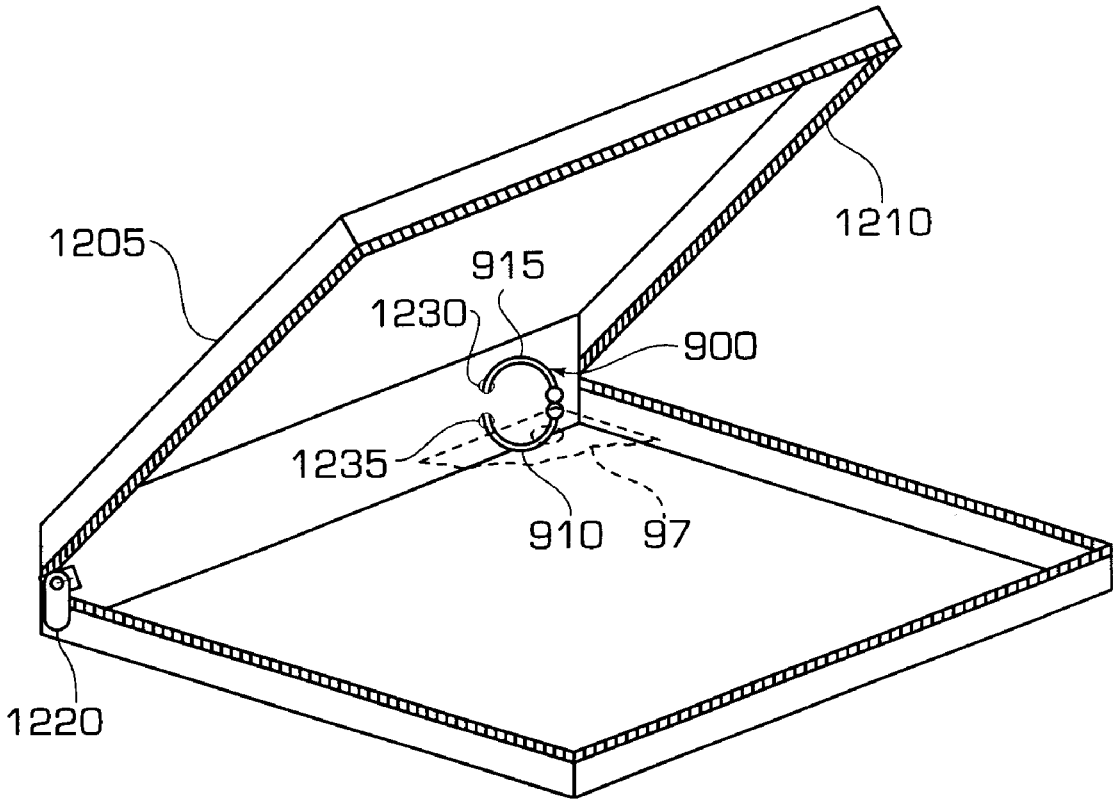
FIG. 12 is a perspective view of the article holder of the third embodiment attached to a jacket.

FIG. 12 shows the third embodiment of the device 900 attached to a jacket 1205. The jacket 1205 covers an article 97 held on the device 900, an article such as a card, key, or the like. The jacket includes a zipper pull 1220 and zipper teeth 1210. The spine 970 of the device 900 is embedded within the jacket 1205 in such a manner so that the half-rings 910, 915 protruding through through-holes 1230, 1235 are visible.

The operation of the third embodiment will be described in the following.

Figure 10:
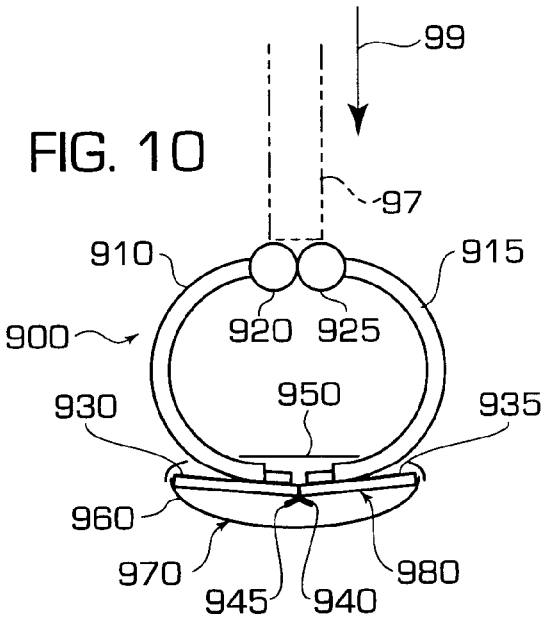
FIG. 10 is a lateral view of the article holder of the third embodiment with an edge of an article pushing against the tips in a closed position.
Figure 11:
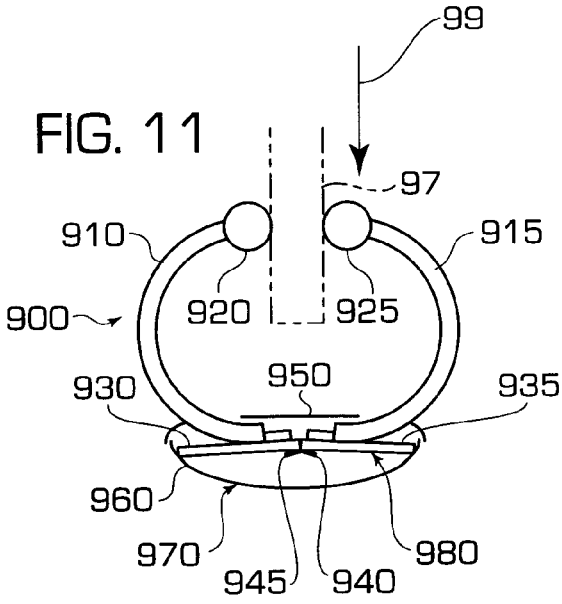
FIG. 11 is a lateral view of the article holder of the third embodiment with the tips in an open position.

The insertion of an article 97 is shown in FIGS. 10 and 11. Initially, the leaves 930, 935 are disposed against each other along their longitudinal medial edge on a non-coplanar plane, as shown in FIG. 10. As the edge of the article 97 is pushed in between the ball-shaped tips 920, 925 through the action of a pushing force 99, the curvature of the ball-shaped tips 920, 925 deflects the pushing force 99 along a direction substantially nonlinear to the direction of the pushing force 99. The deflected pushing force spreads apart the ball-shaped tips 920, 925 from a rest, or closed, position and hingedly displaces the pair of leaves 930, 935 toward a more coplanar orientation. The hinged motion of the pair of leaves 930, 935 pushes against the inner longitudinal edges of the lower cylindrical cover 960. The flexibility of the lower cylindrical cover 960 permits the hinged motion of the pair of leaves 930, 935 toward a coplanar orientation through the action of the pushing force 99 and, at the same time, yieldingly urges the pair of leaves 930, 935 away from a coplanar orientation, to the rest position.

As the article 97 is inserted between the ball-shaped tips 920, 925 in the open position, as shown in FIG. 11, the maximum hinged motion of the pair of leaves 930, 935 is limited by the two pairs of tabs 940, 945. A hole in the article 97 is aligned with the ball-shaped tips 920, 925 to permit the ball-shaped tips to return to the closed position and to complete the insertion of the article 97 onto the device 900.

To extract the article 97, the hole in the article 97 is aligned in between the ball-shaped tips 920, 925. A pulling motion in a direction opposite to the pushing force 99 will displace the ball-shaped tips 920, 925 apart and hingedly displace the pair of leaves 930, 935 to an open position. After the article is extracted from the ball-shaped tips 920, 925, the device 900 returns to the closed position.

Further, alternatively, another method of holding articles together is explained below in connection with FIGS. 10 and 11. A pair of half-rings 910, 915 of annular or non-annular shape is formed into a configuration such that distal ends are opposed to one another and tips 920, 925 are respectively disposed at the distal ends. The half-rings 910, 915 are yieldingly urged toward each other by the action of a spine 970 attached to the base of the pair of half-rings 910, 915. An edge of an article 97 is pushed in between the tips to push the tips 920, 925 apart. An article 97 is slid in between the tips 920, 925 and a hole in the article 97 is threaded through the tips 920, 925. The articles held on the device are covered by a jacket 1205 (in FIG. 12) attached to the spine 970.

Figure 13:
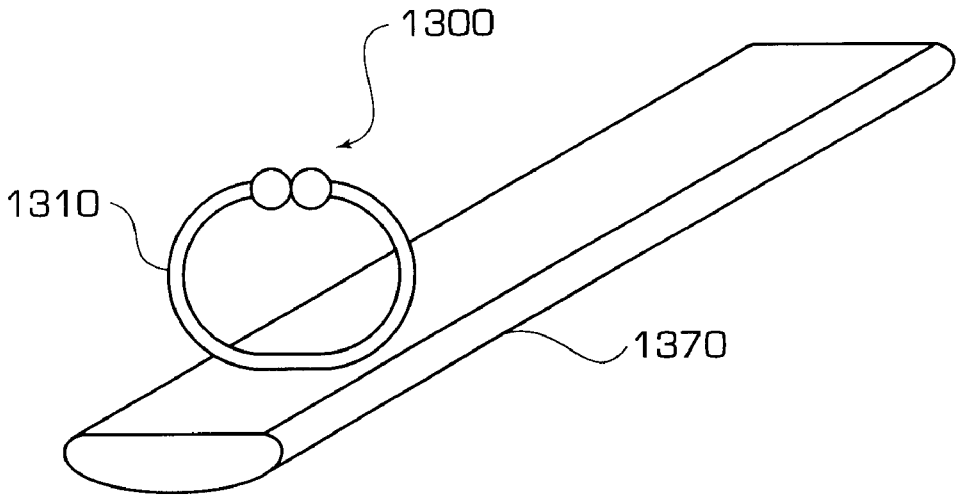
FIG. 13 is a perspective view of the article holder of another embodiment with an open ring attached to a solid spine.

Alternatively, as shown in FIG. 13, a device 1300 has an open ring 1310 which may be rigidly fixed to a longitudinal spine 1370 extending in a direction normal to the plane of the open ring 1310.

In using the invention, pushing or pulling an article such as a plastic card or a key will simultaneously create an opening sufficient to insert or extract an article on the ring. In contrast to the prior art, a separate act of twisting laterally as in U.S. Pat. No. 1,407,863 (Hochenauer), twisting axially as in U.S. Pat. No. 2,871,691 (Bacon), or twisting longitudinally as in U.S. Pat. No. 123,360 (Porter et al.) is not required to open the device. In all the referenced prior art, with the exception of U.S. Pat. No. 5,038,926 (van der Toorn) which does not disclose a method of insertion or extraction, insertion or extraction requires the additional steps of opening and closing the device. In the present invention, insertion or extraction does not require a separate step of opening or closing the device.

It is contemplated that numerous modifications may be made to the present invention without departing from the spirit and scope of the invention as defined in the following claims.

What is claimed is:

1. A device for holding together cards, comprising:

a) an open ring in one of an annular and a non annular shape having distal ends that are opposed to one another;

b) a tip disposed at each of the distal ends of the open ring, the tips being operative to be displaced apart with respect to each other by pushing an edge of the card against the tips to create a sufficiently wide opening between the tips to allow the card to be inserted into or extracted from the device;

c) a spine member disposed at a base of the open ring, the spine member rigidly fixing the open ring in an upright position so that the open ring does not pivot in a longitudinal direction of the spine member; and d) a jacket attached to and covering the spine member so that the open ring protrudes through at least one through-hole in the jacket, wherein the device is assembled together such that the card is insertable into the open ring without a user touching the open ring.

2. The device as claimed in claim 1, wherein the open ring comprises one pair of opposing half-rings, wherein a base of each half-ring is attached to the spine member.

3. The device as claimed in claim 2, wherein the spine member further comprises:

an inner longitudinal member disposed at the base of the pair of half-rings, the inner longitudinal member operative to yieldingly urge the half-rings toward each other; and a spine cover housing the inner longitudinal member.

4. The device as claimed in claim 3, wherein the inner longitudinal member comprises:

a) a pair of opposing and abutting leaves wherein each leaf is disposed at the base of a half-ring and hingedly cooperates with the opposing leaf along a longitudinal medial edge, the pair of opposing leaves yieldingly urging the half-rings toward each other; and b) at least one tab extending from the longitudinal medial edge of each leaf for limiting the hinge motion of the pair of leaves.

5. The device as claimed in claim 4, wherein the spine cover further comprises:

a) an upper cover with a pair of overlapping longitudinal edges extending downward and a pair of apertures through which the ring halves project; and b) a lower cover with a pair of longitudinal edges extending upward and inward, each longitudinal edge of the lower cover disposed between an overlapping longitudinal edge of the upper cover and an outer longitudinal edge of a leaf.

6. The device as claimed in claim 5, wherein the spine member is embedded within the jacket and the pair of half-rings protrude through through-holes on an inner surface of the jacket.

7. The device as claimed in claim 1, wherein the tips are of a spherical shape.

8. The device as claimed in claim 1, wherein the tips are of a teardrop shape.

9. The device as claimed in claim 1, wherein the tips are of a tapered shape.

10. In combination with at least one of a card and a key, a device for holding together at least one of cards and keys, comprising:

a) a pair of opposing half-rings in one of an annular and a non annular shape, formed into a configuration such that a distal end of one half-ring opposes a distal end of another half-ring;

b) a spine member disposed at a base of the pair of half-rings, the spine member operative to yieldingly urge the half-rings toward each other, the spine member rigidly fixing the pair of half-rings in an upright position so that the pair of half-rings do not pivot in a longitudinal direction of the spine member;

c) a tip disposed at each of the distal ends, the tips being operative to be displaced apart with respect to each other by pushing an edge of at least one of the card and the key against the tips to create a sufficiently wide opening between the tips to allow the at least one of the card and the key to be inserted into or extracted from the device; and d) a jacket attached to and covering the spine member so that the pair of half-rings protrude through at least one through-hole in the jacket, wherein the device is assembled together such that the at least one of the card and the key is insertable into the pair of half-rings without a user touching the pair of half-rings.

11. The device as claimed in claim 10, wherein the spine member further comprises:

a) an inner longitudinal member disposed at the base of the pair of half-rings, the inner longitudinal member operative to yieldingly urge the half-rings toward each other; and b) a spine cover to house the inner member.

12. The device as claimed in claim 11, wherein the inner longitudinal member comprises:

a) a pair of opposing and abutting leaves wherein each leaf is disposed at the base of a corresponding one of the half-rings and hingedly cooperates with the opposing leaf along a medial longitudinal edge, the pair of opposing leaves yieldingly urging the half-rings toward each other; and b) at least one tab extending from the longitudinal medial edge of each leaf for limiting the hinge motion of the pair of leaves.

13. The device as claimed in claim 12, wherein the spine cover further comprises:

a) an upper cover with a pair of longitudinal edges extending downward and a pair of apertures through which the ring halves project; and b) a lower cover with a pair of longitudinal edges extending upward and inward, each longitudinal edge of the lower cover disposed between an overlapping longitudinal edge of the upper cover and an outer longitudinal edge of a leaf.

14. The device as claimed in claim 10, wherein the spine member is embedded within the jacket and the pair of half-rings protrude through through-holes on an inner surface of the jacket.

15. The device as claimed in claim 10, wherein the tips are of a spherical shape.

16. The device as claimed in claim 10, wherein the tips are of a teardrop shape.

17. The device as claimed in claim 10, wherein the cards are of a rectangular shape.

18. A method of holding at least one of cards and keys together, said method comprising the steps of:

a) providing a pair of half-rings on a spine member that rigidly fixes the pair of half-rings in an upright position so that the pair of half-rings do not pivot in a longitudinal direction of the spine member, the pair of half-rings forming one of an annular and a non-annular shape, such that distal ends are opposed to one another and tips are respectively disposed at the distal ends;

b) yieldingly urging the half-rings toward each other;

c) pushing an edge of one of a card and a key in between the tips to push the tips apart and sliding the one of-the card and the key in between the tips;

d) threading a distal end through a hole in the one of a card and a key; and e) covering the at least one of cards and keys with a jacket, the jacket attached to and covering the spine so that the pair of half-rings protrude through at least one through-hole in the jacket, wherein the pushing step c) is performed without a user touching the half-rings.

* * * * *